United States Patent [19]

Beaven et al.

[11] Patent Number: 4,686,521

[45] Date of Patent: Aug. 11, 1987

[54] DISPLAY APPARATUS WITH MIXED ALPHANUMERIC AND GRAPHIC IMAGE

[75] Inventors: Paul A. Beaven; Dave A. Canton, both of Romsey; Nick B. Sargeant, Eastleigh; Tom H. Snagge, Bramdean, Nr. Aylresford, all of United Kingdom

[73] Assignee: International Business Machines Corporation, Armonk, N.Y.

[21] Appl. No.: 708,755

[22] Filed: Mar. 6, 1985

[30] Foreign Application Priority Data

Mar. 7, 1984 [EP] European Pat. Off. ..... 84301497.8

[51] Int. Cl.[4] ..... G09G 1/28

[52] U.S. Cl. ..... 340/703; 340/747; 340/748

[58] Field of Search ..... 340/721, 744, 745, 747, 340/748, 750, 703

[56] References Cited

U.S. PATENT DOCUMENTS

| | | | |
|---|---|---|---|
| 3,685,038 | 8/1972 | Flanagan | 340/703 |
| 4,408,198 | 10/1983 | Kudirka | 340/748 X |
| 4,408,200 | 10/1983 | Bradley | 340/703 X |
| 4,441,105 | 4/1984 | Van Vliet et al. | 340/748 X |
| 4,470,042 | 9/1984 | Barnich et al. | 340/745 X |
| 4,555,700 | 11/1985 | Conuis et al. | 340/747 X |
| 4,591,845 | 5/1986 | Komatsu et al. | 340/748 X |

FOREIGN PATENT DOCUMENTS

| | | |
|---|---|---|
| 0096627 | 12/1983 | European Pat. Off. . |
| 0108516 | 5/1984 | European Pat. Off. . |
| 83/02509 | 7/1983 | World Int. Prop. O. . |
| 2105156 | 3/1983 | United Kingdom . |

*Primary Examiner*—Gerald L. Brigance

*Attorney, Agent, or Firm*—Joseph J. Connerton; Frederick D. Poag

[57] ABSTRACT

A graphics display apparatus employing a raster scanned cathode ray tube uses a refresh buffer constituted by a coded alphanumeric buffer and an associated character generator for displaying alphanumeric characters and other symbols and an all-points-addressable buffer for displaying graphics. Serialized data from the two buffers are mixed in a mixer under control of at least one control bit (attribute) stored in the coded buffer to provide a composite pel-representing bit stream supplied to the cathode ray tube.

7 Claims, 11 Drawing Figures

| Fd | Bd |
|---|---|
| 1 | 1 |

| Fd | Bd |
|---|---|
| 1 | 0 |

| Fd | Bd |
|---|---|
| 0 | 1 |

| Fd | Bd |
|---|---|
| 0 | 0 |

BO = 1

BO = 0

DISPLAY APPARATUS WITH MIXED ALPHANUMERIC AND GRAPHIC IMAGE

BACKGROUND OF THE INVENTION

The present invention relates to a display apparatus capable of displaying mixed alphanumeric and graphic images.

The earliest display terminals used as computer data input/output terminals were alphanumeric displays. Subsequently graphic display terminals came into use, initially mainly for military and space purposes but latterly increasingly for commercial and industrial purposes. Typical alphanumeric displays are the IBM 3277, 3278, 3279 and 8775 display stations. Typical graphics displays are the IBM 2250, 3250 and 5080 displays: the IBM 2250 and 3250 displays are directed-beam cathode ray tube (CRT) displays while the IBM 5080 display employs a color raster-scanned CRT. Cathode ray tubes remain the principal display device for many reasons including cost, versatility, efficiency and relative ease of providing color. Although CRTs require refresh, this is not now regarded as a serious drawback in view of the decreasing cost of semiconductor memory (and increasing memory speeds).

At the present time, most alphanumeric displays employ coded character buffers, either mapped or unmapped. Character codes in a mapped buffer correspond to character positions in the screen, whereas an unmapped buffer requires each character code to have its screen address stored therewith. The character codes stored in the refresh buffer serve as pointers to a character generator which contains the bit patterns required to display that character on the CRT screen. Associated with the character codes are attribute codes which determine how the character is to be displayed on the screen. Coded character buffers have proved very successful for alphanumeric displays in view of their relatively small memory requirements. If a loadable character generator is used, graphic pictures can be built up by employing special character shapes or symbols. Although in theory, exactly the same graphics image could be displayed with a coded buffer alphanumeric display as with a full graphics display, in practice there is a limit, partly set by economic considerations and partly by performance considerations. To display a complicated and high-resolution graphics image in an alphanumeric coded-character display would require a very large random access memory in the character generator and too much time loading the required bit patterns into the character generator.

U.S. Pat. No. 4,217,577 describes a character graphics color display system in which graphical images are built up from image or character cells. The specification discusses the various factors which need to be considered when mixing lines of different colors but generally describes a basically alphanumeric display with additional character graphic capability allowing quite complex charts to be displayed. However, for the reasons mentioned above, the described apparatus is not entirely satisfactory for high-function, high resolution, highly-interactive graphics applications.

Bit-for-pel or all point addressable (APA) refresh buffers are fast becoming the standard requirement for fully-interactive high-resolution graphics displays. In such a display, each addressable picture element (pixel or pel) on the screen is represented by one or more bits in the refresh buffer—color displays require 3 planes of memory, red, blue and green. Although such graphics displays are excellent for displaying graphics images and can display any size or shape of alphanumeric character, the latter is quite inefficient in an APA buffer compared with a coded character refresh buffer. For example assume that each character is built up from a matrix of $20\times9$ pels. In an APA buffer this requires $20\times9=180$ bits. For a color display this means at least 540 ($180\times3$) bits are required for each character. In contrast a coded buffer requires only one byte to specify the character and one attribute byte (for color etc.), that is, 16 bits. To change one character on the screen, only these 16 bits need to be changed (and perhaps only the 8 bits specifiying the character if the attributes are unchanged) in contrast to the 540 bits in the APA buffer. Thus from this point of view, the coded buffer can be up to thirty times faster than an APA buffer for changing a character on a color display. Some machines, such as the IBM Personal Computer, allow switching between character and APA modes.

The published PCT patent application No. 83/02509 describes a raster-scan CRT display apparatus in which separate all points addressable memories are used for alphanumeric and graphic images. The alphanumeric memory is effectively an extra plane of APA memory and contain priority bits for determining whether the graphics or alphanumeric data are foreground or background. Alphanumeric-representing bits are read out 8 "pels" at a time with a further six bits representing their color and a further two priority bits controlling the eight alphanumeric bits. The disadvantages with this arrangement are that extra memory is required for the alphanumeric characters than would be required if a coded character buffer were used and increased writing time is required for changing alphanumeric characters. Chromatic Inc's CGC 7900 display system is also an APA graphics display in which two images can be overlayed with different foreground or background colours.

European Patent Specifications EP -A-0096627 and EP -A-0108516 disclose mixing arrangements in which a particular color code (normally black) is used to represent a color signal which enables text data to be displayed instead of graphics data on a pel-by-pel basis. The code represents a transparent color and requires a code for each pel. The article "A VLSI Controller for Bit-Mapped Graphics Display" by James Kahn in Wescon Technical Papers, Vol. 26, September 1982, pages 33/2-1 to 33/2-13 discloses an arrangement in which graphics and alphanumeric data are mixed in a multiplexor. However no details of the control of the multiplexor are given.

CROSS REFERENCES TO RELATED APPLICATION

Co-pending applications Ser. Nos. 675038 and 639760 filed respectively on Nov. 26, 1984 and Aug. 13, 1984 and assigned to the same assignee as the present invention describe, respectively, details of the APA graphics buffer and details of the generation of a cross-hair cursor on the display.

SUMMARY OF THE INVENTION

An object of the present invention is to provide a display apparatus capable of displaying mixed alphanumeric and graphics data which employs a coded character buffer for the display of alphanumeric characters and an APA buffer for the display of a graphics image with a flexible means for mixing the two kinds of data in accordance with attribute information stored with each coded character so that the alphanumeric and graphic images can be mixed on a character basis.

According to the invention, display apparatus comprises a display apparatus having a raster-scanned cathode ray tube display for displaying alphanumeric and graphical data comprising a refresh buffer containing representations of data to be displayed on said cathode ray tube display and refresh logic arranged periodically to address said refresh buffer to obtain pel-defining-bit information, and is characterized in that said refresh buffer includes an alphanumeric coded character buffer for storing coded representations of alphanumeric characters or symbols to be displayed on said display device together with character attribute information determining how said characters are to be displayed, a character generator addressable by said coded representations to provide bit patterns corresponding to said characters to be displayed, an all-points-addressable graphics buffer for containing bits representing a graphical image and a mixer for combining the bit pattern derived from the graphics buffer, with each bit pattern derived from the character generator in accordance with at least one control bit in the attribute information associated with the coded representation in said coded buffer.

BRIEF DESCRIPTION OF DRAWINGS

The invention will now be particularly described, by way of example, with reference to the accompany drawings, in which.

DESCRIPTION OF PREFERRED EMBODIMENT

Figure 1:
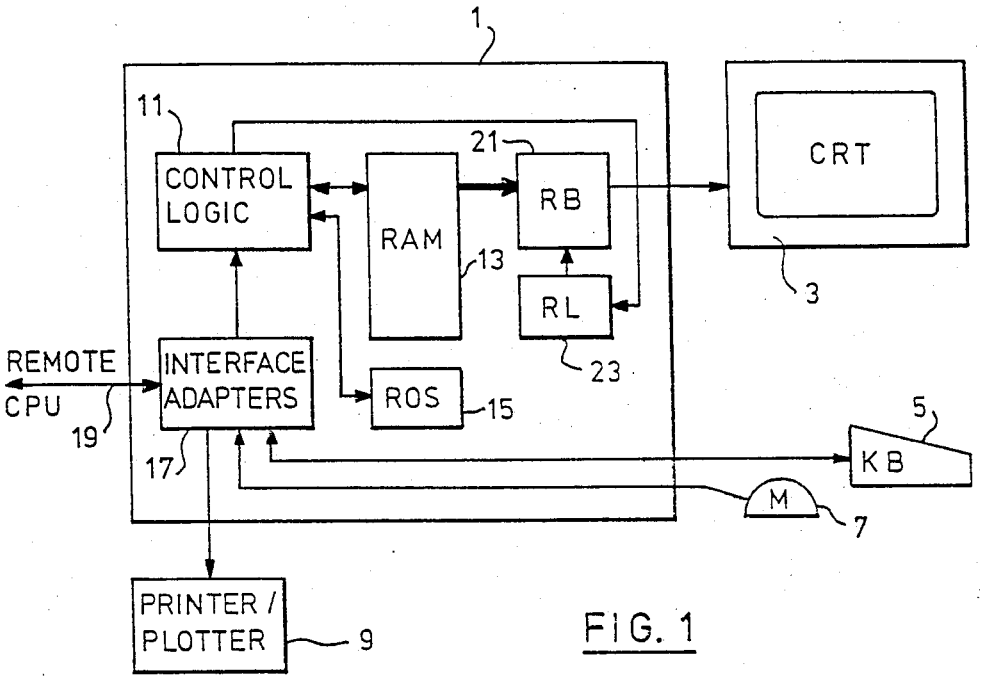
FIG. 1 is a block diagram showing the main elements of a display apparatus.

Referring now to FIG. 1, a display terminal includes a terminal control unit 1, a CRT display monitor 3, a keyboard 5, a so-called mouse 7, and a printer/plotter 9. The terminal control unit 1 includes control logic 11, for example including a microprocessor, random access memory (RAM) 13, read only storage (ROS) 15 and interface adapters 17 whose purpose is to provide appropriate buffering for the attached input/output (I/O) devices and communication to a remote CPU (not shown) on communication line 19. The cathode ray tube display 3 is refreshed from a refresh buffer 21 under control of refresh logic 23. Apart from the I/O devices shown, other I/O devices such as scanners and digitizing tablets, not shown, may be attached to the terminal control unit 1.

Typical display terminals employing the general layout shown in FIG. 1 include the IBM 8775 and 3270PC terminals and the IBM Personal Computers. No description of the various components is necessary except for the refresh buffer 21, which is the part of the terminal with which the present invention is concerned.

Figure 2:
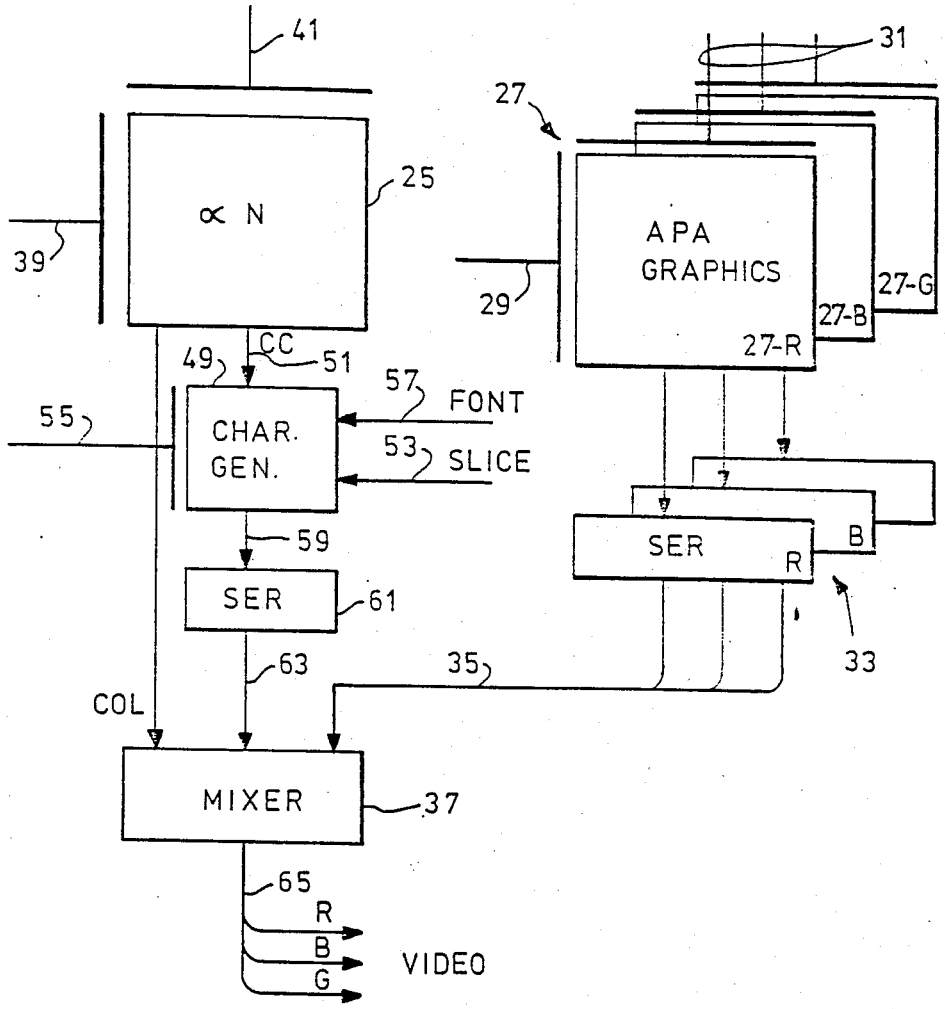
FIG. 2 is a block diagram showing the main elements of the refresh buffer shown in FIG. 1.

As shown in FIG. 2, the refresh buffer includes an alphanumeric coded character buffer 25 and an all-points-addressable (APA) graphics buffer 27 comprising three planes 27-R, 27-B and 27-G containing pel information for the red, blue and green components respectively of the graphic image. Bits representing pels are written into APA buffer 27 along data bus 29 to addresses specified on address buses 31. During refresh, the refresh logic 23 (FIG. 1) addresses the APA buffer 27 along address buses 31 such that successive bytes of pel-representing-bits are read into serializers 33 from which serial streams of bits are passed along bus 35 to mixer 37.

Figure 3:
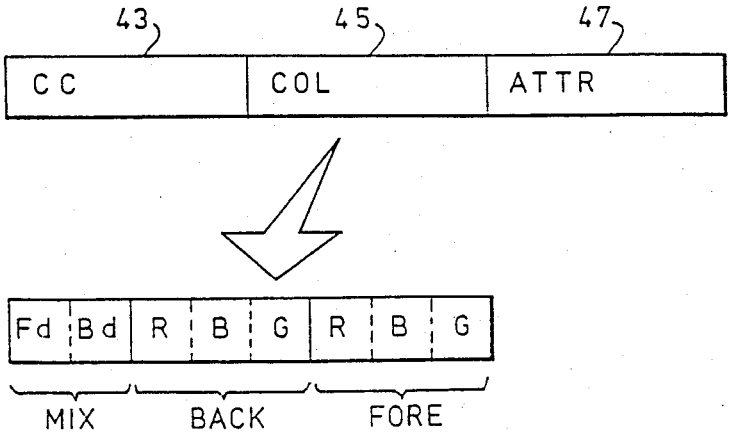
FIG. 3 shows the format of the codes stored in the coded buffer shown in FIG. 2, FIGS. 4 to 7 show the various ways in which a graphics image can be mixed with an alphanumeric character together with the associated mixing control codes.

Coded character buffer 25 is loaded with bytes representing alphanumeric characters (or other symbols) to be displayed by means of data bus 39 and address bus 41. In the preferred embodiment, each character is represented by three bytes 43, 45 and 47 as shown in FIG. 3. Byte 43 is a character code (CC) representing the character to be displayed and serves as a pointer to the character generator 49. Two bits of byte 45 are used to control mixing of graphics and alphanumeric data within the mixer 37 in a manner to be described in more detail below. Three bits of the byte 45 are used to specify the red, blue and green components of the background of the character and the remaining three bits define the red, blue and green components of the foreground of the character. Byte 47 contains further attribute bits which control how the character is displayed, for example, reverse video, overstrike, underscore, highlighted, blinking, etc. Such attribute control of character display is well understood in the art and will not be described further.

Returning to FIG. 2, successive bytes of character codes are read from coded buffer 25 under control of refresh logic 23, FIG. 1, over address bus 41 such that successive character codes (CC) address the character generator 49 along line 51. As is well known, the character generator 49 contains the bit patterns needed to display the characters and each character will need to address it several times to obtain each "slice" of the character. The character generator 49 is also addressed by a slice counter, not shown, on line 53.

Although the character generator 49 could be constituted by a read only store, it is preferably constituted by a random access memory which can be loaded over data bus 55 with different bit patterns. Different fonts, for example bold, italic, APL, etc can be stored in the character generator 49 and these can be selected by means of address line 57. This has the important advantage that the font in which characters are displayed on the screen can be changed without re-writing the coded buffer 25 or the character generator 49.

It is preferred that the memory used for the coded buffer 25 is sufficiently fast as to allow direct accessing of the character generator 49. However it is within the encompass of the present invention for a pair of "ping-pong" character row buffers, not shown, to be interposed between the buffer 25 and the character generator 49; these would allow one row of character codes to address the character generator whilst the next row was being assembled in well known manner.

Slices of character bit patterns are read, byte by byte, along line 59 into serializer 61. The bit pattern is read serially from serializer 61 along line 63 into mixer 37.

Synchronization of the coded alphanumeric buffer 25 and the APA graphics buffer 27 and timing of the various elements of FIG. 2 is under control of the refresh logic 23, FIG. 1. This refresh logic 23 need not be described in detail since its operation will be well understood by those skilled in the art, but it normally would consist of dedicated control logic, for example, a program logic array, shared logic or a suitably programmed microprocessor.

The output 65 of the mixer 37 supplies the red, blue and green video bit information to the CRT display monitor 3, FIG. 1. Before describing the operation of the mixer 37 in detail, reference will be made to FIGS. 4 to 7 which show how the alphanumeric and graphics images may be mixed.

Figure 4:
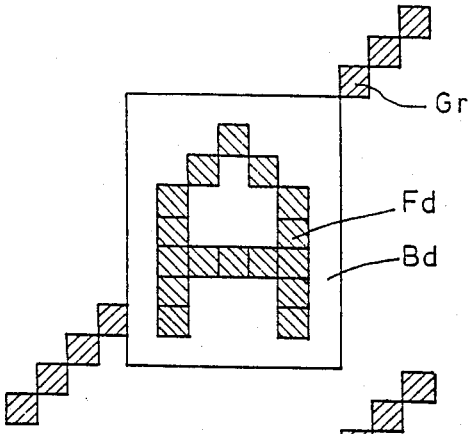

As shown in FIG. 4 and for exemplary purposes only, each character cell consists of a matrix of 7×9 pels, some of which are regarded as foreground (Fd) pels and other as background (Bd) pels. Part of a graphics image (Gr) is shown. In FIG. 4, the mixing control bits Fd and Bd are each given the value 1, resulting in both the character foreground and background overlying the graphics image.

Figure 5:
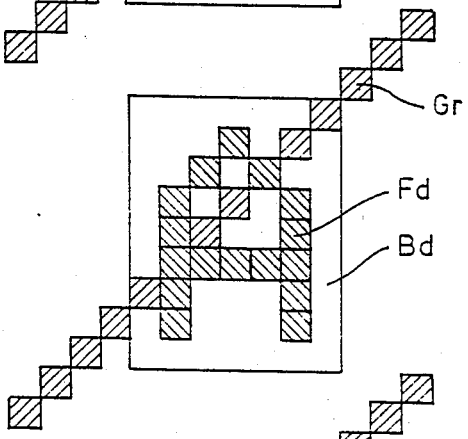
Figure 6:
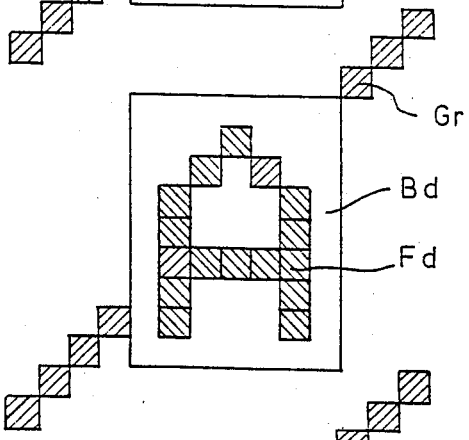
Figure 7:
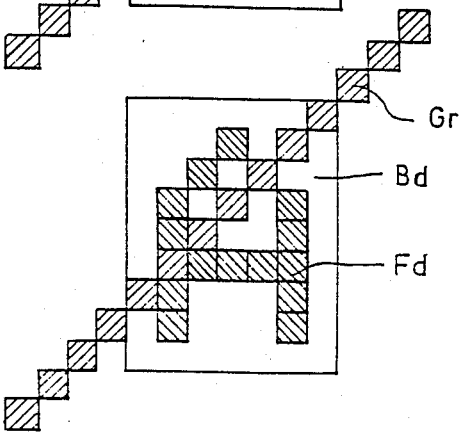

In FIG. 5, the control bits Fd and Bd are given the values "1" and "0" respectively, resulting in the graphics image Gr overlying the character background Bd but with the character foreground Fd overlying the graphics image Gr. In FIG. 5 where the Fd and Bd control bits have the values "0" and "1" respectively, the graphics image Gr overlies the character foreground Fd but is overlaid by the character background Bd. In FIG. 7 where both control bits have the value "0", the graphics data Gr overlies both the character foreground Fd and background Bd.

Figure 8:
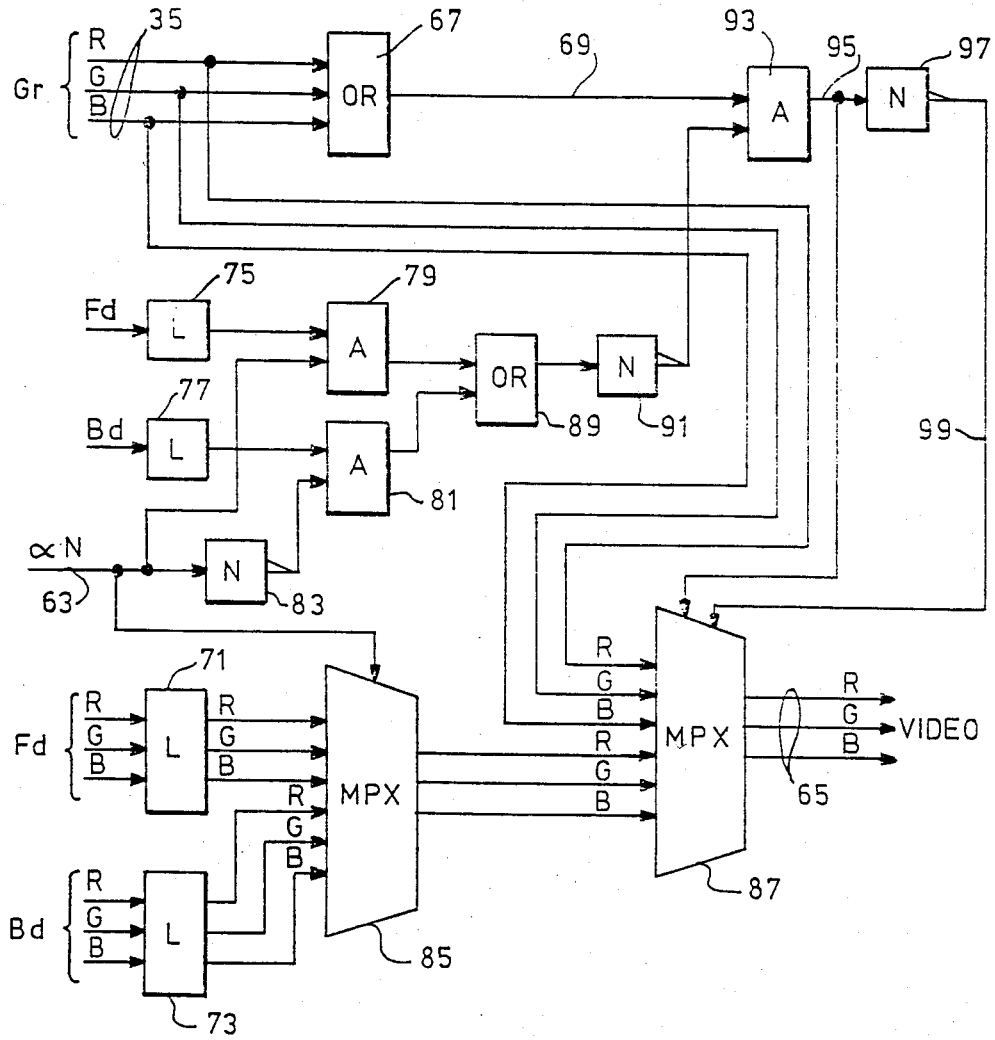
FIG. 8 is a logic diagram showing one implementation of the invention.

It will be appreciated the codes stipulated are exemplary only and that different combinations could be used. FIG. 8 illustrates a logic diagram of how the mixing of FIGS. 4 to 7 could be implemented. In FIG. 8, red, blue and green graphics data received on line 35 is supplied, serially by pel-representing-bit, to an OR gate 67 whose output 69 will be "up" whenever there is a graphics image pel-defining-bit present. The color defining bits of the character foreground and character background of bytes 45 stored in coded buffer 25, FIG. 2, are supplied to latches 71 and 73 respectively. The mix control bits Fd and Bd of bytes 45 are presented to latches 75 and 77 respectively whose outputs are connected to AND gates 79 and 81 respectively. Alphanumeric data received on line 63 is supplied, serially by pel-representing-bit, to AND gate 79 and to inverter 83 whose output is connected to AND gate 81. Bits on line 63 are also supplied to multiplexor 85 to select foreground color codes or background color codes in latches 71 and 73. Thus the presence of a pel-representing-bit on line 63 will cause the foreground color codes to be supplied to a second multiplexor 87 which is also supplied by the color bits received on lines 35.

The outputs of AND gates 79 and 81 are supplied to OR gate 89 whose output will be "up" when the alphanumeric data (foreground or background) are to be overlaid over the graphic data. The output of OR gate 89 is connected to inverter 91 whose output is in turn connected to AND gate 93 which also receives the output 69 of OR gate 67. The output 95 of AND gate 93 will be up when graphics data is to be overlaid over alphanumeric data and to this end output 95 is connected to multiplexor 87 to cause selection of graphic data on line 35. The output 95 is connected to an inverter 97 whose output 99 selects alphanumeric data received by multiplexor 87 from multiplexor 85. The output of multiplexor 87 supplies the red, green and blue video bit information on line 65 to the CRT monitor 3, FIG. 1.

Figure 9:
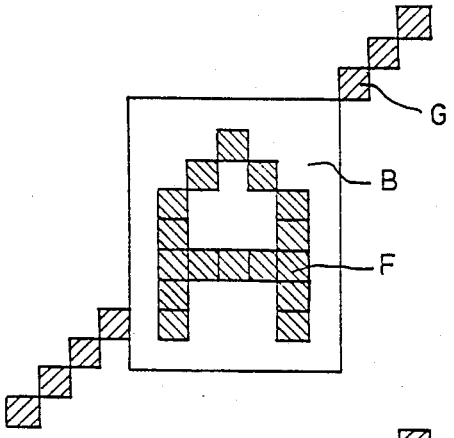
FIGS. 9 and 10 illustrate how graphics and alphanumeric images may be mixed in a simplified arrangement using a single mixing control bit.
Figure 10:
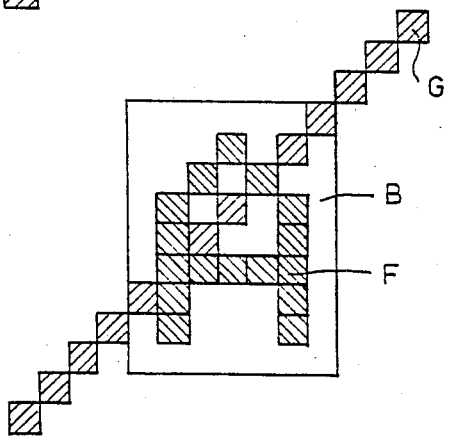
Figure 11:
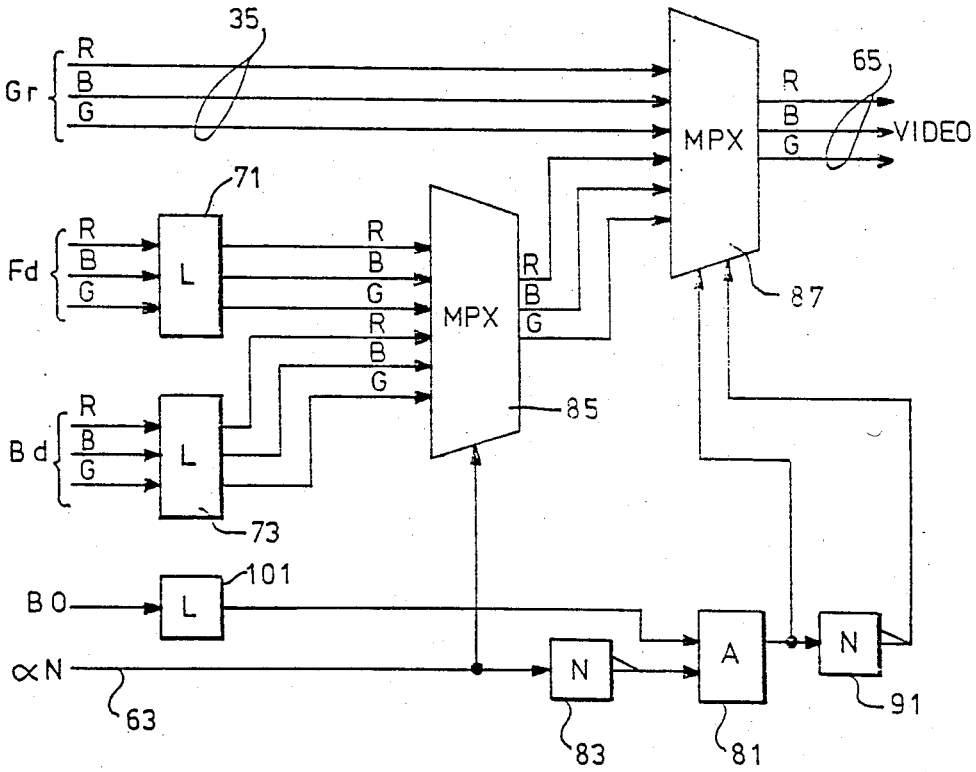
FIG. 11 is a logic diagram showing one implementation of the simplified arrangement.

The logic can be simplified with some sacrifice of versatility by using only 1 bit to control mixing of the alphanumeric and graphic bit streams. FIGS. 9 to 11 show such a simplified arrangement in which alphanumeric foreground data F will always overlay graphic information but where character background data can overlie or underlie graphic data. Thus in FIG. 9, the character background overlies graphics data whereas in FIG. 10 the grahics image overlies the character background. The two control bits Fd and Bd of FIGS. 3 to 8 are replaced by a single control bit BO (background opacity) as indicated in FIGS. 9 and 10.

FIG. 11 shows logic for how such a simplified arrangement might be implemented. Parts corresponding to those of FIG. 8 are shown with corresponding reference numerals. In contrast with FIG. 8, the latches 75 and 77 are replaced by a single latch 101 and the multiplexor 87 has its inputs selected by the output of inverter 91 (rather than that of inverter 99). It will be apparent that less than half the number of logic gates are employed with the simplified arrangement compared with the full arrangement. This makes the simplified arrangement particularly useful if it were desired to convert a standard alphanumerics display into a graphics display by adding the APA buffer 27, serializers 33, mixer 37 and assigning one (or two) character attribute bits to control the mixer 37, and by modifying the refresh logic to address both the coded buffer and the APA buffer. Of course, apart from these hardward changes, the microcode used in the alphanumeric display would also need to be modified to allow use to be made of the added graphics capability.

The invention has been described in terms of a color graphics display but it will be apparent that the principles described are also applicable to a monochrome graphics display—although with the latter only 1 bit would be required for the character foreground and background "colors".

With a graphics display terminal, it is preferable that some sort of cross-hair cursor be employed, controlled, for example, by the mouse 7, FIG. 1. Although bits representing the cross-hair could be written into the APA buffer 27, this would have the drawback that the APA graphics buffer would need to be re-written every time the cursor were moved. It is preferred therefore that the cursor-defining-bits would be added to the bit stream outside the buffer. The afore-said co-pending patent application Ser. No. 639760 describes a preferred embodiment in which the cursor would normally overly the graphics and alphanumeric data but where use may be made of "transparent" cursor lines so as not to obscure the underlying alphanumeric and/or graphic data. Semiconductor random access memory (used for the APA buffer) usually comes in standard-sized modules. The aforesaid co-pending patent application Ser. No. 675038 describes an arrangement in which "spare" memory, which would not normally be used in the APA buffer, can be used in connection with special purpose hardware to increase the writing of complex shaded areas into the APA buffer.

What has been described is a versatile graphics display terminal which uses an APA graphics buffer for graphics images but which uses a coded character buffer for the display of alphanumeric characters. Codes stored with the character codes control mixing of the alphanumeric and graphics images allowing full use of the APA buffer for graphics but with all the advantages of coded buffers for alphanumeric character display. Performance degradation caused by character update is avoided by using the coded buffer and only a relatively few bits in the coded buffer are required to control the mixing of images compared with arrangements which use only APA buffers for both graphics and alphanumeric images. The invention is applicable to interlaced and non-interlaced raster-scan displays.

We claim:

1. Display apparatus having a raster scanned color cathode ray tube display for displaying alphanumeric and graphical data comprising a refresh buffer containing representations of data to be displayed on said cathode ray tube display and refresh logic arranged to periodically address said refresh buffer to obtain pel-defining-bit information, said refresh buffer including an alphanumeric coded character buffer for storing coded representations of alphanumeric characters or symbols to be displayed on said apparatus device together with character attribute information for determining how said characters are to be displayed, said attribute information including foreground and background color definition a character generator addressable by said coded representations to provide bit patterns corresponding to said characters to be displayed, an all points addressable graphics buffer for containing bits representing a graphic image and a mixer for combining the bit pattern derived from the graphics buffer with the bit pattern derived from the character generator in accordance with at least one control bit in the attribute information associated with each coded representation in said coded alphanumeric character buffer.

2. Display apparatus as claimed in claim 1, in which each coded representation is stored in said coded buffer as a character code byte and a color attribute byte containing bits representing the colors of the foreground and background of that character and said at least one control bit.

3. Apparatus as claimed in claim 2, wherein said mixer contains a pair of latches connected to receive respectively character foreground and background color defining bits, first selection means for selecting between the outputs of said latches in accordance with the state of the pel defining bits in the bit stream output from said character generator, control latches for receiving each control bit, and second selection means for selecting between the output of said first selection means and said graphic-image-representing bits received from said graphics buffer in accordance with the contents of each of said control latches.

4. Apparatus as claimed in claim 3, further comprising logic gates connected between the outputs of said control latches and said second selection means and also adapted to receive an input from said character generator bit patterns.

5. Apparatus as claimed in claim 4, in which each said selection means is constituted by a multiplexor.

6. Apparatus as claimed in claim 5, in which said character generator is adapted to contain a plurality of character fonts, and in which said character generator is also addressable by font selection means.

7. Apparatus as claimed in claim 6, comprising a plurality of serializers adapted to receive graphic and character data byte by byte and to supply said graphics and character data to said mixer bit by bit.

* * * * *